US010071583B2

(12) United States Patent
Nashner

(10) Patent No.: US 10,071,583 B2
(45) Date of Patent: Sep. 11, 2018

(54) MARKING OF PRODUCT HOUSINGS

(75) Inventor: Michael Nashner, San Jose, CA (US)

(73) Assignee: APPLE INC., Cupertino, CA (US)

( * ) Notice: Subject to any disclaimer, the term of this patent is extended or adjusted under 35 U.S.C. 154(b) by 1591 days.

(21) Appl. No.: 13/021,641

(22) Filed: Feb. 4, 2011

(65) Prior Publication Data

US 2011/0123737 A1 May 26, 2011

Related U.S. Application Data

(63) Continuation-in-part of application No. 12/895,384, filed on Sep. 30, 2010, which is a continuation-in-part of application No. 12/643,772, filed on Dec. 21, 2009.

(60) Provisional application No. 61/252,623, filed on Oct. 16, 2009.

(51) Int. Cl.

| | |
|---|---|
| ***C25D 11/18*** | (2006.01) |
| ***C25D 11/04*** | (2006.01) |
| ***B41M 5/26*** | (2006.01) |

(52) U.S. Cl.

CPC ..... *B41M 5/262* (2013.01); *C25D 11/04* (2013.01); *C25D 11/18* (2013.01); *Y10T 156/1041* (2015.01); *Y10T 428/13* (2015.01)

(58) Field of Classification Search

CPC ..... C25D 11/18; B41M 5/24
USPC ..... 205/224, 229, 221
See application file for complete search history.

(56) References Cited

U.S. PATENT DOCUMENTS

| | | | |
|---|---|---|---|
| 2,647,079 | A | 7/1953 | Burnham |
| 2,812,295 | A | 11/1957 | Patrick |
| 2,990,304 | A | 6/1961 | Cybriwsky et al. |
| 3,080,270 | A | 3/1963 | Fritz |
| 3,316,866 | A | 11/1965 | Orlin |
| 3,526,694 | A | 9/1970 | Lemelson |
| 3,615,432 | A | 10/1971 | Jenkins et al. |
| 3,645,777 | A | 2/1972 | Sierad |
| RE28,225 | E | 11/1974 | Heseltine et al. |
| 2,346,531 | A | 1/1981 | Adachi et al. |
| 4,247,600 | A | 1/1981 | Adachi et al. |
| 4,269,947 | A | 5/1981 | Inata et al. |
| 4,347,428 | A | 8/1982 | Conrad et al. |
| 4,531,705 | A | 7/1985 | Nakagawa et al. |
| 4,547,649 | A | 10/1985 | Butt et al. |
| 4,564,001 | A | 1/1986 | Maeda |

(Continued)

FOREIGN PATENT DOCUMENTS

| | | | |
|---|---|---|---|
| CN | 1362125 | A | 8/2002 |
| CN | 1306526 | C | 3/2007 |

(Continued)

OTHER PUBLICATIONS http://dba.med.sc.edu/price/irf/Adobe_tg/models/cielab.html, published 2000.*

(Continued)

*Primary Examiner* — Brian W Cohen
(74) *Attorney, Agent, or Firm* — Brownstein Hyatt Farber Schreck, LLP

(57) ABSTRACT

Techniques or processes for providing markings on products are disclosed. In one embodiment, the products have housings and the markings are to be provided on the housings. For example, a housing for a particular product can include an outer housing surface and the markings can be provided in the outer housing surface so as to be visible from the outside of the housing.

8 Claims, 18 Drawing Sheets

(56) References Cited

U.S. PATENT DOCUMENTS 4,651,453 A 3/1987 Doyle
4,686,352 A 8/1987 Nawrot et al.
4,756,771 A 7/1988 Brodalla et al.
2,989,325 A 6/1990 Mullaney
4,931,366 A 6/1990 Mullaney
4,993,148 A 2/1991 Adachi et al.
5,202,013 A * 4/1993 Chamberlain ..... C25D 11/18 205/120
5,215,864 A 6/1993 Laakmann
5,224,197 A 6/1993 Zanoni et al.
5,288,344 A 2/1994 Peker et al.
5,417,905 A 5/1995 Lemaire et al.
5,645,964 A 7/1997 Nohr et al.
5,719,379 A 2/1998 Huang et al.
5,744,270 A 4/1998 Pearlman et al.
5,789,466 A 8/1998 Birmingham et al.
5,808,268 A 9/1998 Balz
5,837,086 A 11/1998 Leeb et al.
5,872,699 A 2/1999 Nishii et al.
5,925,847 A 7/1999 Rademacher et al.
5,943,799 A 8/1999 Xu et al.
6,007,929 A 12/1999 Robertson et al.
6,101,372 A 8/2000 Kubo
6,169,266 B1 1/2001 Hughes
6,325,868 B1 12/2001 Kim et al.
6,331,239 B1 12/2001 Shirota et al.
6,480,397 B1 11/2002 Hsu et al.
6,540,667 B2 4/2003 Cochran
6,574,096 B1 6/2003 Difonzo et al.
6,590,183 B1 7/2003 Yeo
6,633,019 B1 10/2003 Gray
6,746,724 B1 6/2004 Robertson et al.
6,802,952 B2 10/2004 Hsu et al.
6,821,305 B2 11/2004 Yan
6,966,133 B2 11/2005 Krings et al.
6,996,425 B2 2/2006 Watanabe
7,065,820 B2 6/2006 Meschter
7,134,198 B2 11/2006 Nakatani et al.
7,181,172 B2 2/2007 Sullivan et al.
7,225,529 B2 6/2007 Wang
7,284,396 B2 10/2007 Barron et al.
7,459,373 B2 12/2008 Yoo
7,508,644 B2 3/2009 Cheung et al.
7,622,183 B2 11/2009 Shirai et al.
7,636,974 B2 12/2009 Meschter et al.
7,691,189 B2 4/2010 En et al.
8,192,815 B2 6/2012 Weber et al.
8,367,304 B2 2/2013 Heley et al.
8,379,678 B2 2/2013 Zhang et al.
8,379,679 B2 2/2013 Zhang et al.
8,451,873 B2 5/2013 Zhang
8,663,806 B2 3/2014 Weber et al.
8,761,216 B2 6/2014 Zhang
8,809,733 B2 8/2014 Scott et al.
8,842,351 B2 9/2014 Lawrence et al.
8,879,266 B2 11/2014 Jarvis et al.
8,893,975 B2 11/2014 Sanford et al.
8,993,921 B2 3/2015 Browning et al.
9,034,166 B2 5/2015 Tatebe et al.
9,089,932 B2 7/2015 Lim
9,132,510 B2 9/2015 Nashner et al.
9,133,559 B2 9/2015 Silverman
9,138,826 B2 9/2015 Harrison
9,173,336 B2 10/2015 Bhatia
9,185,835 B2 11/2015 Heley et al.
9,314,871 B2 4/2016 Nashner et al.
2001/0030002 A1 10/2001 Zheng et al.
2002/0058737 A1 5/2002 Nishiwaki et al.
2002/0097440 A1 7/2002 Paricio et al.
2002/0109134 A1 8/2002 Iwasaki et al.
2002/0130441 A1 9/2002 Robinson et al.
2002/0160145 A1 10/2002 Bauhoff
2003/0006217 A1 1/2003 Dance
2003/0024898 A1 2/2003 Natsume et al.
2003/0074814 A1 4/2003 Krings et al.
2003/0225189 A1 12/2003 Fuller
2004/0000490 A1 1/2004 Chang
2005/0023022 A1 2/2005 Kriege et al.
2005/0034301 A1 2/2005 Wang
2005/0115840 A1 6/2005 Dolan
2005/0127123 A1 6/2005 Smithers
2005/0158576 A1 7/2005 Groll
2005/0263418 A1 12/2005 Bastus
2006/0007524 A1 1/2006 Tam
2006/0055084 A1 3/2006 Yamaguchi et al.
2006/0066771 A1 3/2006 Hayano et al.
2006/0105542 A1 5/2006 Yoo
2006/0225918 A1 10/2006 Chinda et al.
2007/0018817 A1 1/2007 Marmaropoulos et al.
2007/0045893 A1 3/2007 Asthana et al.
2007/0053504 A1 3/2007 Sato et al.
2007/0262062 A1 11/2007 Guth
2007/0275263 A1 11/2007 Groll
2008/0152859 A1 6/2008 Nagal
2008/0165485 A1 7/2008 Zadesky et al.
2008/0166007 A1 7/2008 Hankey
2008/0241478 A1 10/2008 Costin et al.
2008/0274375 A1 11/2008 Ng et al.
2008/0295263 A1 12/2008 Meschter et al.
2008/0299408 A1 12/2008 Guo et al.
2008/0311369 A1 12/2008 Yokoyama et al.
2008/0311370 A1 12/2008 Yokoyama et al.
2009/0017242 A1 1/2009 Weber et al.
2009/0019737 A1 1/2009 Moreno
2009/0091879 A1 4/2009 Lim
2009/0104949 A1 4/2009 Sato et al.
2009/0136723 A1 5/2009 Zhao
2009/0190290 A1 7/2009 Lynch et al.
2009/0194444 A1 8/2009 Jones
2009/0197116 A1 8/2009 Cheng et al.
2009/0236143 A1 9/2009 Nakamura
2009/0260871 A1 10/2009 Weber et al.
2009/0305168 A1 12/2009 Heley et al.
2010/0015578 A1 1/2010 Falsafi et al.
2010/0061039 A1 3/2010 Sanford et al.
2010/0065313 A1 3/2010 Takeuchi et al.
2010/0159273 A1 6/2010 Filson et al.
2010/0159274 A1 6/2010 Filson et al.
2010/0183869 A1 7/2010 Lin et al.
2010/0209721 A1 8/2010 Irikura et al.
2010/0209722 A1 8/2010 Irikura et al.
2010/0209731 A1 8/2010 Hamano
2010/0294426 A1 11/2010 Nashner
2010/0300909 A1 12/2010 Hung
2011/0008618 A1 1/2011 Weedlun
2011/0048755 A1 3/2011 Su et al.
2011/0051337 A1 3/2011 Weber et al.
2011/0089039 A1 4/2011 Nashner et al.
2011/0089067 A1 4/2011 Scott et al.
2011/0123737 A1 5/2011 Nashner et al.
2011/0186455 A1 8/2011 Du et al.
2011/0193928 A1 8/2011 Zhang et al.
2011/0193929 A1 8/2011 Zhang et al.
2011/0194574 A1 8/2011 Zhang et al.
2011/0155901 A1 10/2011 Hum et al.
2011/0253411 A1 10/2011 Hum et al.
2011/0315667 A1 12/2011 Reichenback et al.
2012/0043306 A1 2/2012 Howerton et al.
2012/0081830 A1 4/2012 Yeates et al.
2012/0100348 A1 4/2012 Brokhyser et al.
2012/0248001 A1 10/2012 Nashner
2012/0275130 A1 11/2012 Hsu et al.
2012/0275131 A1 11/2012 Hsu et al.
2013/0075126 A1 3/2013 Nashner et al.
2013/0083500 A1 4/2013 Prest et al.
2013/0129986 A1 5/2013 Heley et al.
2014/0009873 A1 1/2014 Nashner
2014/0134429 A1 5/2014 Weber et al.
2014/0186654 A1 7/2014 Zhang
2014/0363608 A1 12/2014 Russell-Clarke et al.
2014/0367369 A1 12/2014 Nashner et al.
2014/0370325 A1 12/2014 Nashner et al.

(56) References Cited

U.S. PATENT DOCUMENTS

| | | | |
|---|---|---|---|
| 2015/0093563 | A1 | 4/2015 | Runge et al. |
| 2015/0132541 | A1 | 5/2015 | McDonald et al. |
| 2015/0176146 | A1 | 6/2015 | Browning et al. |

FOREIGN PATENT DOCUMENTS

| | | | | |
|---|---|---|---|---|
| CN | 201044438 | Y | 2/2008 | |
| CN | 101204866 | | 6/2008 | |
| CN | 102173242 | A | 9/2011 | |
| DE | 195 23 112 | | 6/1996 | |
| DE | 102005048870 | A1 | 4/2007 | |
| EP | 0031463 | | 7/1981 | |
| EP | 0 114 565 | A1 | 8/1984 | |
| EP | 121150 | A1 | 10/1984 | |
| EP | 0234121 | | 9/1987 | |
| EP | 0 633 585 | A | 1/1995 | |
| EP | 0 997 958 | A1 | 5/2000 | |
| EP | 2 399 740 | A1 | 12/2011 | |
| EP | 2488369 | B1 | 3/2014 | |
| GB | 788 329 | A | 12/1957 | |
| JP | 57-149491 | A | 9/1982 | |
| JP | 03 013331 | A | 1/1991 | |
| JP | 03 138131 | A | 6/1991 | |
| JP | 3-203694 | A | 9/1991 | |
| JP | 06-126192 | | 5/1994 | |
| JP | A H06-212451 | | 8/1994 | |
| JP | 06-320104 | | 11/1994 | |
| JP | 7-204871 | A | 8/1995 | |
| JP | 2000-000167 | | 1/2000 | |
| JP | 2002/370457 | | 12/2002 | |
| JP | 2003055794 | | 2/2003 | |
| JP | 2005/22924 | | 1/2005 | |
| JP | A2006-138002 | | 6/2006 | |
| JP | 2008 087409 | A | 4/2008 | |
| WO | WO 98/53451 | | 11/1998 | |
| WO | WO 0077883 | | 12/2000 | |
| WO | WO 01/15916 | A1 | 3/2001 | |
| WO | WO 01/34408 | | 5/2001 | |
| WO | WO 2006/124279 | A2 | 11/2006 | |
| WO | WO-2007049064 | A1 * | 5/2007 | ..... B41M 5/26 |
| WO | WO 2007/088233 | A1 | 8/2007 | |
| WO | WO 2008/092949 | A1 | 8/2008 | |
| WO | WO 2009/051218 | A1 | 4/2009 | |
| WO | WO 2010/095747 | A1 | 8/2010 | |
| WO | WO 2010/111798 | A1 | 10/2010 | |
| WO | WO 2010/135415 | | 11/2010 | |
| WO | WO2010/135415 | A2 | 11/2010 | |
| WO | WO 2011/047325 | A1 | 4/2011 | |

OTHER PUBLICATIONS http://www.merriam-webster.com/dictionary/spot, 2007.*

"DP2UV Basic System 2 W", ROBA Technology + Services GmbH, Aug. 2008, 2 pgs.

Annerfors et al., "Nano Molding Technology on Cosmetic Aluminum Parts in Mobile Phones", Division of Production and Materials Engineering, LTH, 2007.

"Thermal Shock Resistant Conformal Coating", Product Data Sheet, Dymax Corporation, Jul. 9, 2007, pp. 1-2.

"Marking Lasers: Marking without Limitations", Trumpf Inc., Sep. 10, 2007, pp. 1-36.

"UV-Curing Sheet Adhesives", ThreeBond Technical News, Issued Jul. 1, 2009, 8 pages.

Chang, "Lasers Make Other Metals Look Like Gold", New York Times, nytimes.com, 2 pgs., Jan. 31, 2008.

"Database EPI" Week 201107 Thomas Scientific, London, GB; AN 2010-Q46184, Nov. 17, 2010, 1 pg.

Hajdu, "Chapter 7", 1990, William Andrew Publishing from www.knovel.com, pp. 193-206.

* cited by examiner

| Laser Model | FOBA DP20GS | SPI 12W/SM | SPI 20W/SM | Lumera |
|---|---|---|---|---|
| Laser Type | DPSS YV04 | Fiber | Fiber | Picosecond |
| Average Power in Watts | 18.4 | 9 | 18 | 2.5 |
| Wavelength in Nanometers | 1064 | 1062 | 1062 | 1064 |
| Pulse Width in Nanoseconds | 20 | 10 to 50 | 12 | 0.015 |
| Frequency in Kilohertz | 40 | 100 to 240 | 400 | 500 |
| Pulse Energy in milliJoules | 0.46 | 0.04 to 0.09 | 0.045 | 0.005 |
| Peak Power in Kilowatts | 23 | 0.75 to 9 | 3.75 | 333 |
| Spot Diameter (1/e^2) in microns | 250 | 80 | 80 | 80 |
| Fluence in Joules per square centimeter | 0.94 | 0.08 to 1.80 | 0.90 | 0.10 |
| Irradiance in Gigawatts per square centimeter | 0.05 | 0.01 to 0.18 | 0.003 | 6.63 |
| Line Spacing in microns | 10 | 5 to 20 | 3 | 20 |
| Scan Speed in millimeters per second | 20 | 20 | 20 | 20 |

FIG. 5

MARKING OF PRODUCT HOUSINGS

CROSS-REFERENCE TO RELATED APPLICATIONS

This application is a continuation-in-part of U.S. application Ser. No. 12/895,384, filed Sep. 30, 2010 and entitled "SUB-SURFACE MARKING OF PRODUCT HOUSINGS," which is hereby incorporated herein by reference, which in turn is a continuation-in-part of U.S. application Ser. No. 12/643,772, filed Dec. 21, 2009 and entitled "SUB-SURFACE MARKING OF PRODUCT HOUSINGS," which is hereby incorporated herein by reference, which claims priority benefit of U.S. Provisional Application No. 61/252,623, filed Oct. 16, 2009 and entitled "SUB-SURFACE MARKING OF PRODUCT HOUSINGS," which is hereby incorporated herein by reference.

BACKGROUND OF THE INVENTION

Field of the Invention

The present invention relates to marking products and, more particularly, marking housings of electronic devices.

Description of the Related Art

Consumer products, such as electronic devices, have been marked with different information for many years. For example, it is common for electronic devices to be marked with a serial number, model number, copyright information and the like. Conventionally, such marking is done with an ink printing or stamping process. Although conventional ink printing and stamping is useful for many situations, such techniques can be inadequate in the case of handheld electronic devices. The small form factor of handheld electronic devices, such as mobile phones, portable media players and Personal Digital Assistants (PDAs), requires that the marking be very small. In order for such small marking to be legible, the marking must be accurately and precisely formed. Unfortunately, however, conventional techniques are not able to offer sufficient accuracy and precision. Thus, there is a need for improved techniques to mark products.

SUMMARY

The invention pertains to techniques or processes for providing markings on products. In one embodiment, the products have housings and the markings are to be provided on the housings. For example, a housing for a particular product can include an outer housing surface and the markings can be provided on the outer housing surface so as to be visible from the outside of the housing. The markings provided on products can be textual and/or graphic. The markings can be formed with high resolution. The markings are also able to be light or dark (e.g., white or black), even on metal surfaces.

In general, the markings (also referred to as annotations or labeling) provided on products according to the invention can be textual and/or graphic. The markings can be used to provide a product (e.g., a product's housing) with certain information. The marking can, for example, be use to label the product with various information. When a marking includes text, the text can provide information concerning the product (e.g., electronic device). For example, the text can include one or more of: name of product, trademark or copyright information, design location, assembly location, model number, serial number, license number, agency approvals, standards compliance, electronic codes, memory of device, and the like). When a marking includes a graphic, the graphic can pertain to a logo, a certification mark, standards mark or an approval mark that is often associated with the product. The marking can be used for advertisements to be provided on products. The markings can also be used for customization (e.g., user customization) of a housing of a product.

The invention can be implemented in numerous ways, including as a method, system, device, or apparatus. Several embodiments of the invention are discussed below.

As a method for marking an article, one embodiment can, for example, include at least providing a metal structure for the article, adherently coupling material of a thin film adjacent to a surface of the metal structure, so as to provide a resulting structure having a lightness factor magnitude in a visible color space, and selectively altering the thin film for substantially increasing the lightness factor magnitude of selected regions of the resulting structure, while substantially maintaining adherent coupling of the material of the thin film.

As another method for marking an article, one embodiment can, for example, include at least: providing a metal structure for the article, adherently coupling material of a thin film adjacent to a surface of the metal structure, so as to provide a resulting structure having a lightness factor magnitude in a visible color space, and altering the lightness factor magnitude of selected regions of the resulting structure, while substantially maintaining adherent coupling of the material of the thin film.

As another method, one embodiment can, for example, include at least providing an article comprising aluminum metal, anodizing the article to create an anodized layer; and creating light scattering points within the anodized layer, the light scattering points providing a white or translucent appearance above the aluminum metal, which is disposed beneath the anodized layer.

As another embodiment, the electronic device housing can, for example, include at least a metal structure having a lightness factor magnitude in a visible color space; a substantially translucent thin film coupled adjacent to a surface of the metal structure, so as to provide a resulting structure; and textual or graphical marking indicia on the electronic device housing selected altered regions of the resulting structure having a lightness factor magnitude substantially different than that of the metal structure.

As an electronic device housing, one embodiment can, for example, include at least a metal structure, a thin film coupled adjacent to a surface of the metal structure, and selectively fractured regions of the thin film that are substantially smooth.

As another electronic device housing, one embodiment can, for example, include at least a housing structure including at least an outer portion and an inner portion, the outer portion being anodized and the inner portion being unanodized, and selectively altered surface regions formed within the outer portion of the housing structure. The altered surface regions provide marking of the electronic device housing.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which:

FIG. 5 is a table illustrating exemplary laser operation parameters for dark or black marking of the metal structure according to one embodiment.

DETAILED DESCRIPTION OF EMBODIMENTS OF THE INVENTION

Figure 1:
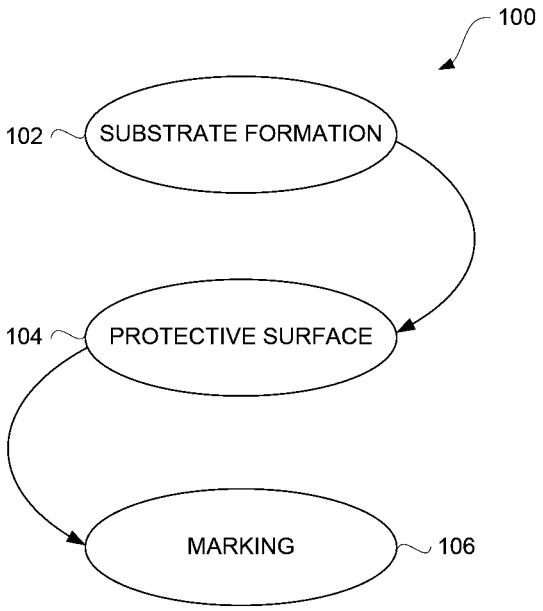
FIG. 1 is a diagram of a marking state machine according to one embodiment.

The invention pertains to techniques or processes for providing markings on products. In one embodiment, the products have housings and the markings are to be provided on the housings. For example, a housing for a particular product can include an outer housing surface and the markings can be provided on an outer housing surface so as to be visible from the outside of the housing. The markings provided on products can be textual and/or graphic. The markings can be formed with high resolution. The markings are also able to be light or dark (e.g., white or black), even on metal surfaces.

In general, the markings (also referred to as annotations or labeling) provided on products can be textual and/or graphic. The markings can be used to provide a product (e.g., a product's housing) with certain information. The marking can, for example, be use to label the product with various information. When a marking includes text, the text can provide information concerning the product (e.g., electronic device). For example, the text can include one or more of: name of product, trademark or copyright information, design location, assembly location, model number, serial number, license number, agency approvals, standards compliance, electronic codes, memory of device, and the like). When a marking includes a graphic, the graphic can pertain to a logo, a certification mark, standards mark or an approval mark that is often associated with the product. The marking can be used for advertisements to be provided on products. The markings can also be used for customization (e.g., user customization) of a housing of a product.

Appearance of the housing, and in particular appearance of markings on the housing may be described using CIE 1976 L*a*b* (also known as CIELAB), which is a color space standard specified by the International Commission on Illumination (French Commission internationale de l'éclairage). CIELAB describes colors visible to the human eye and was created to serve as a device independent model to be used as a reference. The three coordinates of the CIELAB standard represent: 1) the lightness factor magnitude of the color (L*=0 yields ultimate black and L*=100 indicates diffuse ultimate white, 2) its position between red/magenta and green (a*, negative values indicate green while positive values indicate magenta) and 3) its position between yellow and blue (b*, negative values indicate blue and positive values indicate yellow). As discussed in further detail subsequently herein, measurements in a format corresponding to the CIELAB standard may be made using a spectrophotometer, such as the COLOREYE™ XTH spectrophotometer, which was sold by GretagMacbeth™. Similar spectrophotometers are available from X-Rite™.

Exemplary embodiments of the invention are discussed below with reference to FIGS. 1-10B. However, those skilled in the art will readily appreciate that the detailed description given herein with respect to these figures is for explanatory purposes as the invention extends beyond these limited embodiments.

FIG. 1 is a diagram of a marking state machine 100 according to one embodiment of the invention. The marking state machine 100 reflects three (3) basic states associated with marking an electronic device. Specifically, the marking can mark a housing of an electronic device, such as a portable electronic device.

The marking state machine 100 includes a substrate formation state 102. At the substrate formation state 102, a substrate can be obtained or produced. For example, the substrate can represent at least a portion of a housing surface of an electronic device. Next, the marking state machine 100 can transition to a protective surface state 104. At the protective surface state 104, a protective surface can be formed or applied to at least one surface of the substrate. The protective surface can be used to protect the surface of the substrate. For example, the protective surface can be a more durable surface than that of the surface of the substrate. Next, the marking state machine 100 can transition to a marking state 106. At the marking state 106, marking can be produced on the substrate (e.g., produced sub-surface to the protective surface) and/or produced in the protective surface. The marking can be provided with high resolution. Since the marking may be provided while maintaining smoothness of the protective surface, the marking has the advantage of not being perceptible of tactile detection on the surface.

Figure 2:
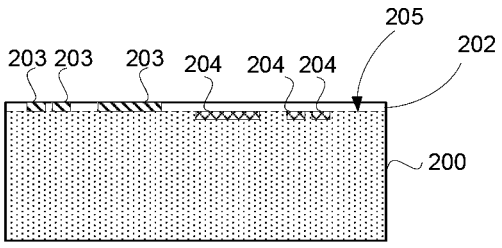
FIG. 2 is an illustration of a substrate having marking alterations according to one embodiment.

FIG. 2 is an illustration of a substrate 200 and an adjacently coupled protective thin film 202. The substrate 200 may comprise metal, and in particular may comprise aluminum. The substrate may be substantially gray, and is depicted in the figures using stippling (i.e., pattern of small dots). The protective thin film 202 may comprise an anodized layer 202.

As shown in FIG. 2, marking alterations 203, 204 may include light or white alterations 203 (depicted with left to right hatching) that may be created by microfracturing of the thin film 202 while still maintaining a tactilely smooth surface of the thin film 202; and/or may include dark or black subsurface alterations 204 (depicted with cross hatching.) The sub-surface alterations 204 are provided below the thin film 202 and on a top surface 205 of the substrate 200. Given that the thin film 202 is typically substantially translucent (e.g., clear), the sub-surface alterations 204 may be visible to a user through the thin film 202.

Accordingly, the sub-surface alterations 204 can provide dark or black markings on the substrate 200. Since the dark or black markings are provided by the sub-surface alterations 204, the markings are protected by the thin film 202 provided on the substrate 200. Further, the sub-surface alterations may be made visible while maintaining the tactilely smooth surface of the thin film 202.

The substrate 200 can represent at least a portion of a housing of an electronic device. The marking being provided to the substrate 200 can provide text and/or graphics to an outer housing surface of an electronic device, such as a portable electronic device. The marking techniques are particularly useful for smaller scale portable electronic devices, such as electronic devices. Examples of handheld electronic devices include mobile telephones (e.g., cell phones), Personal Digital Assistants (PDAs), portable media players, remote controllers, pointing devices (e.g., computer mouse), game controllers, etc.

Figure 3A:
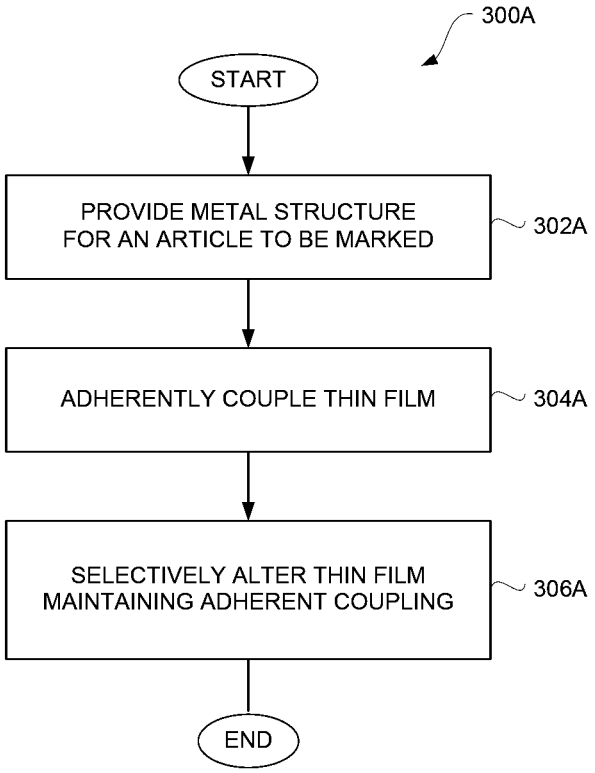
FIGS. 3A-3C are flow diagrams of marking processes according to one embodiment.
Figure 3B:
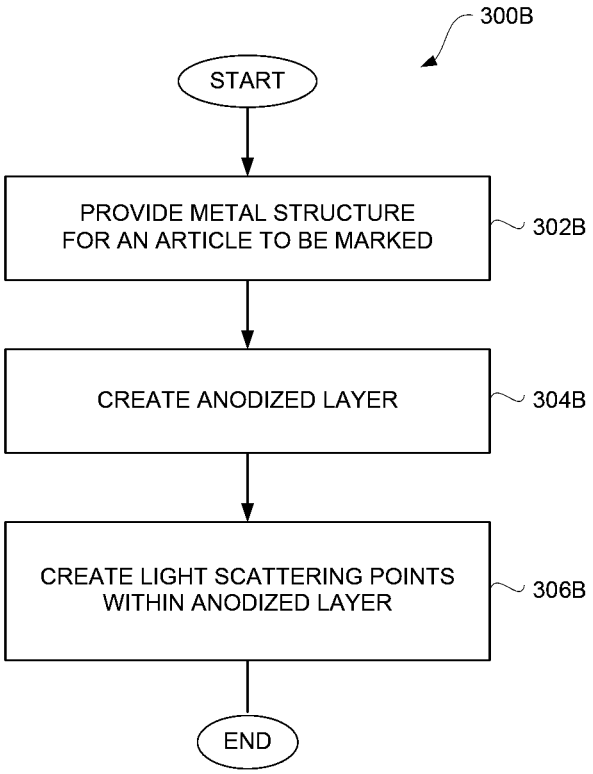
Figure 3C:
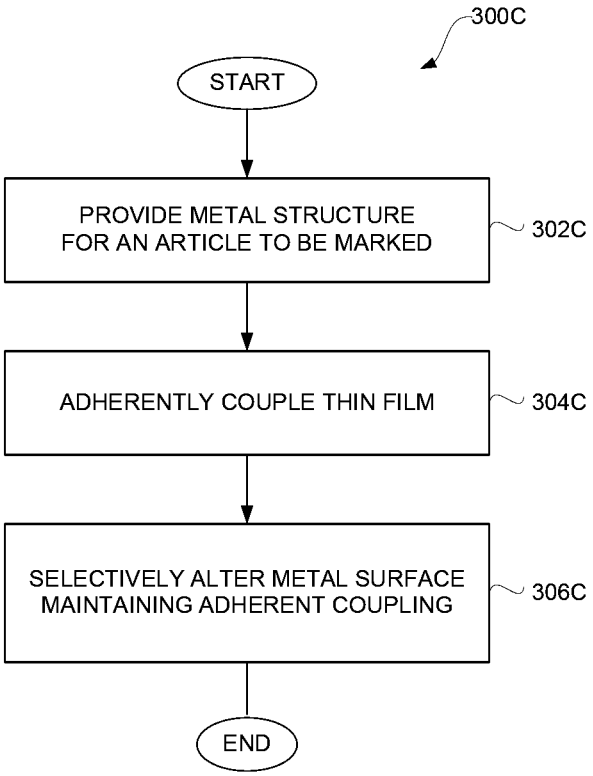

FIGS. 3A-3C are flow diagrams of marking processes 300A, 300B, 300C according to one embodiment. The marking processes 300A, 300B, 300C can be performed on an electronic device that is to be marked. The marking processes 300A, 300B, 300C are, for example, suitable for applying text or graphics to a housing (e.g., an outer housing surface) of an electronic device. The marking can be provided such that it is visible to users of the electronic device. However, the marking can be placed in various different positions, surfaces or structures of the electronic device.

The marking processes 300A, 300B, 300C can provide a metal structure for an article to be marked. The metal structure can pertain to a metal housing for an electronic device, such as a portable electronic device, to be marked. The metal structure can be formed of one metal layer. The metal structure can also be formed of multiple layers of different materials, where at least one of the multiple layers is a metal layer. The metal layer can, for example, be or include aluminum, titanium, niobium or tantalum.

In accordance with the marking process 300A shown in FIG. 3A, the process may begin with providing 302A the metal structure for an article to be marked. After the metal structure has been provided 302A, material of a thin film may be adherently coupled 304A adjacent to a surface of the metal structure, so as to provide a resulting structure having a lightness factor magnitude in a visible color space. In one embodiment, the surface of the metal structure may be anodized 304A to adherently couple material of the thin film (e.g. anodized layer.) Typically, the surface of the metal structure to be anodized 304A is an outer or exposed metal surface of the metal structure. For example, the outer or exposed surface can represent an exterior surface of the metal housing for the electronic device.

Given that the thin film (e.g., anodized layer) is typically substantially translucent (e.g., clear), the metal of the resulting structure may be gray and may be substantially visible through the thin film. Measuring lightness factor magnitude of the resulting structure using a spectrophotometer, in accordance with the CIELAB standard scale, the lightness factor magnitude may be about 68 (which may be referred to as "L*68").

Thereafter, as shown in the process 300A of FIG. 3A, the thin film may be selectively altered 306A for increasing substantially the lightness factor magnitude of selected regions of the resulting structure, while substantially maintaining adherent coupling of the material of the thin film. The selectively altering 306A of the thin film may increase the lightness factor magnitude to be substantially above fifty. For example, in measurements of selected altered thin film regions using a spectrophotometer, in accordance with the CIELAB scale, the selected altered thin film regions showed an increased lightness factor magnitude, which was about 86.6 (which may be referred to as L*86.6).

Increasing substantially the lightness factor magnitude may provide a substantially lightened visible appearance, and may provide a substantially white visible appearance, of the selected regions of the resulting structure. In other words, selectively altering 306A the thin film may provide a substantially lightened visible appearance, and may provide a substantially white visible appearance, of the thin film of selected regions of the resulting structure. Accordingly, selectively altering 306A the thin film may cause substantially white marking of the resulting structure.

Selectively altering 306A the thin film may be employed for marking the article by altered lightness characteristics of selected regions of the resulting structure, which may cause one or more light textual or graphical indicia to appear on the resulting structure. Further, as will be discussed in greater detail subsequently herein, selectively altering 306A the thin film for increasing substantially the lightness factor magnitude of selected regions of the resulting structure may comprise lightness halftoning, wherein the selected regions of the thin film may be arranged in a lightness halftone pattern.

Selectively altering 306A the thin film may comprises fracturing and, more particularly, may comprise microfracturing the thin film of selected regions of the resulting structure. For example, the thin film can pertain to an anodized layer selectively altering the thin film may comprise selectively altering an anodized layer discussed previously herein. Accordingly, selectively altering the thin film may comprises fracturing and, more particularly, may comprise microfracturing the anodized layer of selected regions of the resulting structure.

Selectively altering 306A the thin film may comprise heating, and in particular may comprise laser heating of selected regions of the resulting structure. Selectively altering 306A the thin film may comprise heating the metal surface of selected regions of the resulting structure. Selectively altering 306A the thin film may comprise fracturing the thin film (e.g., anodized layer) adjacent to the surface of the metal structure, by heating the metal surface of selected regions of the resulting structure.

The material of the thin film may be substantially more brittle than metal of the metal structure. In other words, the metal of the metal structure may be substantially more ductile than the material of the thin film. Further, thermal expansion in response to heating of the metal of the metal structure may be substantially greater than thermal expansion in response heating of the thin film. Moreover, laser selection and operation may be controlled so that laser heating by electron-phonon coupling may predominate over other laser effects; and electron-phonon coupling of the metal of the metal structure may be substantially higher than electron-phonon coupling of the thin film, so that laser heating of the metal of the metal structure may be substantially greater than laser heating of the thin film. Accordingly, selectively heating of the metal surface of selected regions of the resulting structure may selectively alter 306A the thin film by fracturing the thin film adjacent to the surface of the metal structure. In other words, the foregoing different responses to heating of the metal and the adherently coupled thin film may contribute to stresses in excess of fracture tolerance of the thin film, which may result in fracturing of the thin film.

For example, aluminum oxide of an anodized layer may be substantially more brittle than aluminum metal of the metal structure. In other words, the aluminum metal of the metal structure may be substantially more ductile than the aluminum oxide of the anodized layer. Further, thermal expansion in response to heating of the aluminum metal of the metal structure may be substantially greater than thermal expansion in response to heating of the aluminum oxide of the anodized layer. Moreover, in the case of laser heating by electron-phonon coupling, electron-phonon coupling of the aluminum metal of the metal structure may be substantially higher than electron-phonon coupling of the aluminum oxide of the anodized layer, so that laser heating of the aluminum metal of the metal structure may be substantially greater than laser heating of the aluminum oxide of the anodized layer. Accordingly, selectively heating the aluminum metal surface of selected regions of the resulting structure may selectively alter 306A the anodized layer by fracturing (e.g., microfracturing) the anodized layer adjacent to the surface of the metal structure. In other words, the foregoing different responses to heating of the aluminum metal and the adherently coupled aluminum oxide of the anodized layer may contribute to stresses in excess of fracture tolerance of the anodized layer, which may result in fracturing of the anodized layer.

Substantially maintaining adherent coupling of the material of the thin film to the metal substrate may substantially avoid etching of the material of the thin film material. For example, substantially maintaining adherent coupling of the aluminum oxide material of an anodized layer may substantially avoid etching the aluminum oxide material of the anodized layer when being selectively altered 306A. Accordingly, selectively altering 306A the thin film may maintain a tactilely smooth surface of the thin film. In such case, the thin film may be selectively altered by microfracturing the thin film, while maintain the tactilely smooth surface of the thin film. Moreover, measurements by an optical surface profiler may show substantially no change in thin film surface topology due to selectively altering 306A the thin film, while also substantially maintaining adherent coupling of the material of the thin film. In particular, microfracturing the thin film, while substantially maintaining adherent coupling of the material of the thin film, may show substantially no change in thin film surface topology in measurements by the optical surface profiler. In other words, the selectively altering 306A of the thin film may induce micro-features therein (e.g., microfracturing) but can doe so without destruction of the thin layer.

Selectively altering 306A the thin film may comprise directing a laser output through the thin film adjacent to a surface of the metal structure, and towards the surface of the metal structure. As will be discussed in greater detail subsequently herein the laser output may be controlled for substantially maintaining adherent coupling of the material of the thin film, so as to avoid various deleterious effects, while white marking select portions of the thin film via micro-fracturing. The laser output may be controlled so as to maintain the tactilely smooth surface of the thin film. The laser output may be controlled so as to substantially avoid laser etching of the thin film. The laser output may be controlled so as to substantially avoid ablation of the metal or thin film.

Accordingly, substantially maintaining adherent coupling 306A of the material of the thin film may comprise substantially avoiding laser etching of the material of the thin film material. Substantially maintaining adherent coupling 306A of the material of the thin film may also comprise substantially avoiding ablation of the material of the thin film.

Selectively altering 306A the thin film may employ a suitably selected and operated laser for providing the laser output. For example, one specific suitable laser may be operated in substantially continuous wave (CW) mode at a selectively limited power of two (2) Watts and at an infrared wavelength (10.6 micron wavelength), such as the Alltec laser model CO2 LC100, which may be obtained from Alltec GmbH, An der Trave 27-31, 23923 Selmsdorf, Germany. Accompanying optics may be used to provide a laser output spot size within a range from approximately seventy (70) microns to approximately one-hundred (100) microns. For a spot of about 0.00005 square centimeters, selectively limits irradiance to approximately forty (40) Kilo-Watts per square centimeter, for selectively altering 306A the thin film, while substantially maintaining adherent coupling of the material of the thin film. It should be understood that the foregoing are approximate exemplary laser operating parameters, and that various other laser operating parameters may be suitable for selectively altering 306A the thin film, while substantially maintaining adherent coupling of the material of the thin film. Laser output spot size and/or irradiance may be selected for selectively altering 306A the thin film, while substantially maintaining adherent coupling of the material of the thin film. The foregoing may substantially avoid etching or ablation of the material of the thin film material; may maintain a tactilely smooth surface of the thin film; and/or may substantially avoid changes in thin film surface topology.

Selectively altering 306A the thin film may comprise directing the laser output towards the surface of the metal structure, while limiting power of the laser output, so as to substantially avoid ablation of the metal of the metal structure. The metal may be characterized by an ablation threshold irradiance, and the laser output may have an irradiance that is approximately less than the ablation threshold irradiance of the metal, for substantially avoiding ablation of the metal of the metal structure. Following the block 306A of selectively altering the thin film, the marking process 300A shown in FIG. 3A can end.

In accordance with the marking process 300B shown in FIG. 3B, the process may begin with providing 302B the metal structure for an article to be marked, wherein the metal may comprise aluminum metal. After the metal structure has been provided 302B, the article may be anodized for creating 304B an anodized layer. After creating 304B the anodized layer, light scattering points may be created 306B within the anodized layer, for example, by microfracturing the anodized layer. The light scattering points may provide a white or translucent appearance above the aluminum metal, which is disposed beneath the anodized layer. Following the block 306B of creating the light scattering points, the marking process 300B shown in FIG. 3B can end.

In accordance with the marking process 300C shown in FIG. 3C, the process may begin with providing 302C the metal structure for an article to be marked. After the metal structure is provided 302C, material of a thin film may be adherently coupled 304C adjacent to a surface of the metal structure, so as to provide a resulting structure having a lightness factor magnitude in a visible color space. The metal of the resulting structure may be gray and may be substantially visible through the thin film. Measuring lightness factor magnitude of the resulting structure using a spectrophotometer, in accordance with the CIELAB standard scale, the lightness factor magnitude may be about 68 (which may be referred to as "L*68"). The surface of the metal structure may be anodized 304C to adherently couple material of the thin film (e.g. anodized layer). For example, after the metal structure has been provided 302C, the surface of the metal structure can be anodized 304C.

Thereafter, as shown in the process 300C of FIG. 3C, surface characteristics of selected regions of the surface of the metal structure may be selectively altered 306C, for example may be selectively roughened, for decreasing substantially the lightness factor magnitude of selected regions of the resulting structure, while substantially maintaining adherent coupling of the material of the thin film. Such selective roughening may be ultrasmall scale roughening, for example the ultrasmall scale roughening may comprise nanoscale roughening. Selectively altering 306C of the metal surface may decrease the lightness factor magnitude to be substantially below fifty. For example, in measurements of selected altered metal surface regions using a spectrophotometer, in accordance with the CIELAB standard scale, the selected altered metal surface regions showed a decreased lightness factor magnitude, which may range in magnitude from about twenty to about thirty (which may be referenced as about "L*20" to about "L*30".)

Decreasing substantially the lightness factor magnitude may provide a substantially darkened visible appearance, and may provide a substantially black visible appearance, of the selected regions of the resulting structure. In other words, selectively altering 306C the metal surface may provide a substantially darkened visible appearance, and may provide a substantially black visible appearance, of the metal surface of selected regions of the resulting structure. Accordingly, selectively altering 306C the metal surface may cause substantially black marking of the resulting structure.

Selectively altering 306C the metal surface may be employed for marking the article by altered darkness characteristics of selected regions of the resulting structure, which can be used to form one or more dark textual or graphical indicia to appear on the resulting structure. Further, as will be discussed in greater detail subsequently herein, selectively altering 306C the metal surface for decreasing substantially the lightness factor magnitude of selected regions of the resulting structure may comprise darkness halftoning, wherein the selected regions of the metal surface may be arranged in a darkness halftone pattern.

Substantially maintaining adherent coupling of the material of the thin film may substantially avoid etching or ablation of the material of the thin film material. The thin film can be a layer of aluminum oxide material. For example, substantially maintaining adherent coupling of an aluminum oxide material of an anodized layer may substantially avoid etching or ablation the aluminum oxide material of the anodized layer. Accordingly, selectively altering 306C the metal surface may substantially maintain a tactilely smooth surface of the thin film. In such case, the metal surface may be selectively altered beneath the thin film, while the thin film remains substantially in place, and while substantially maintaining the tactilely smooth surface of the thin film.

Selectively altering 306C the metal surface may comprise directing a laser output through the thin film (e.g., anodized layer) adjacent to the surface of the metal structure, and towards the surface of the metal structure. Typically, the surface of the metal structure to be anodized is an outer or exposed metal surface of the metal structure. The outer or exposed surface with anodized layer typically represents an exterior surface of the metal housing for the electronic device. Thereafter, surface characteristics of selected portions of an inner unanodized surface of the metal structure may be altered 306C. The inner unanodized surface may be part of the metal layer that was anodized, or may be part of another metal layer that was not anodized.

As will be discussed in greater detail subsequently herein, the laser output may be controlled for substantially maintaining adherent coupling of the material of the thin film, so as to avoid various deleterious effects, while black marking the metal surface. The laser output may be controlled so as to maintain substantially the tactilely smooth surface of the thin film. The laser output may be controlled so as to substantially avoid laser etching of the thin film. The laser output may be controlled for substantially avoiding ablation of the metal or thin film.

Accordingly, substantially maintaining adherent coupling 306C of the material of the thin film may comprise substantially avoiding laser etching of the material of the thin film material. Substantially maintaining adherent coupling 306C of the material of the thin film may also comprise substantially avoiding ablation of the material of the thin film.

Selectively altering 306C the metal surface may employ a suitably selected and operated laser for providing the laser output. The surface characteristics can be altered 306C using a laser, such as an infrared wavelength laser (e.g., picosecond pulsewidth infrared laser or nanosecond pulsewidth infrared laser). For example, one specific suitable laser is a six (6) Watt infrared wavelength picosecond pulsewidth laser at 1000 KHz with a scan speed of 50 mm/sec. While such picosecond pulsewidth laser may provide many advantages, it may be more expensive than an alternative nanosecond pulsewidth laser. Accordingly, an example of a suitable alternative laser is a ten (10) Watt infrared wavelength nanosecond pulsewidth lasers at 40 KHz with a scan speed of 20 mm/sec. Fluence of pulses of the laser may be selected so as to be approximately less than an ablation threshold fluence that characterizes the metal. Selection of the laser fluence may be for substantially avoiding ablation of the metal. Further, fluence of pulses of the laser may be selected so as to be greater than a damage fluence that characterizes the metal, so as to provide for altering surface characteristics of the selected portions of the inner unanodized surface of the metal structure. Accompanying optics may be used to provide a laser output spot size within a selected range, as discussed in greater detail subsequently herein.

Laser output spot size and/or irradiance may be selected for selectively altering 306C the metal surface, while substantially maintaining adherent coupling of the material of the thin film. The foregoing may substantially avoid etching or ablation of the material of the thin film material; may substantially maintain a tactilely smooth surface of the thin film; and/or may substantially avoid changes in thin film surface topology.

Selectively altering 306C the metal surface may comprise directing the laser output towards the surface of the metal structure, while limiting power of the laser output, so as to substantially avoid ablation of the metal of the metal structure. The metal may be characterized by an ablation threshold irradiance and/or ablation threshold fluence, and the laser output may have an irradiance and/or fluence that is approximately less than the ablation threshold irradiance and/or ablation threshold fluence of the metal, for substantially avoiding ablation of the metal of the metal structure. Following the block 306C of selectively altering the metal surface, the marking process 300C shown in FIG. 3C can end.

The process 300B shown in FIG. 3B and the process 300C shown in FIG. 3C can be considered embodiment of the process 300A shown in FIG. 3A.

Figure 4A:
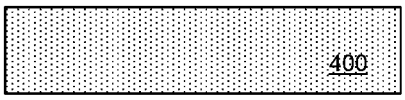
FIGS. 4A-4D are diagrams illustrating marking of a metal structure according to one embodiment.
Figure 4B:
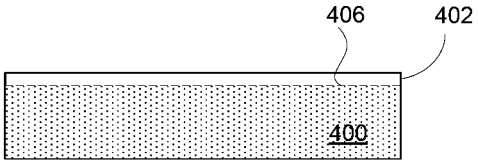

FIGS. 4A-4D are diagrams illustrating marking of a metal structure according to one embodiment. FIG. 4A illustrates a base metal structure 400. As an example, the base metal structure 400 can be formed of aluminum, titanium, niobium or tantalum. In FIGS. 4A-4D, the base metal structure may be substantially gray, and is depicted in the FIGS. 4A-4D using stippling. FIG. 4B illustrates the base metal structure 400 after an upper surface has been anodized to form an anodized surface 402. The thickness of the anodized surface 402 can, for example, be about 5-20 microns. The anodized surface 402 can be considered a thin film, which represents a coating or layer. Aluminum oxide material of the anodized surface may be adherently (e.g., chemically bonded) coupled adjacent to an inner unanodized surface 406 of the metal structure 400.

Figure 4C:
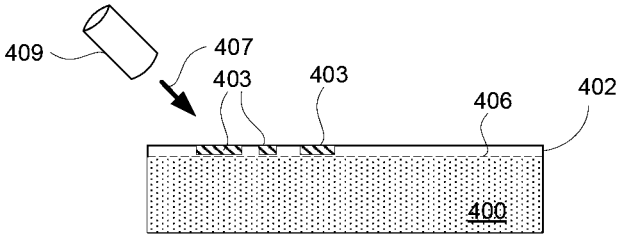

After the anodized surface 402 has been formed on the base metal structure 400, FIG. 4C illustrates light (e.g., white) alterations 403 (depicted with left to right hatching) that may be created by microfracturing of the anodized surface 402, while substantially maintaining adherent coupling of the aluminum oxide material of the anodized surface 402 adjacent to the inner unanodized surface 406 of the metal structure 400. The light alterations 403 are formed by suitably selected optical energy 407 produced by a suitably selected and operated laser 409 (as discussed in detail previously herein with respect to light or white marking). The altered surfaces 403 combine to provide marking of the metal structure 400. For example, the light alterations 403 appear to be light, and thus when selectively formed can provide light or white marking. The light or white marking can also be provided in lightness halftone arranged in a suitably selected lightness halftone pattern. If the anodized surface is dyed or colored, the markings may appear in different colors.

The laser 407 may include a galvanometer mirror or other arrangement for raster scanning a spot of the optical energy over the anodized surface 402, so as to form the light alterations into a rasterized depiction of the light (e.g., white) marking indicia. Suitable pitch between raster scan lines of the scanning spot for the light (e.g., white) marking may be selected. For example, pitch between raster scan lines may be about fifty (50) microns, and scan speed may be about two hundred (200) millimeters per second.

Figure 4D:
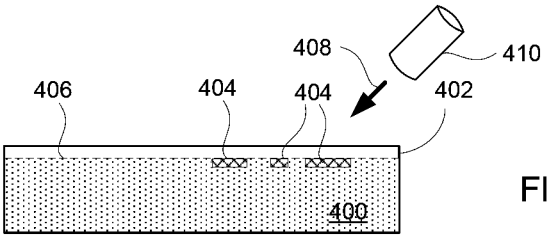

Alternatively or additionally, after the anodized surface 402 has been formed on the base metal structure 400, FIG. 4D illustrates altered surfaces 404 (depicted with cross hatching) being selectively formed on an inner unanodized surface 406, while substantially maintaining adherent coupling of the aluminum oxide material of the anodized surface 402 adjacent to the inner unanodized surface 406 of the metal structure 400. Such altered structures 404 are formed for dark (e.g., black) marking by suitably selected optical energy 408 produced by a suitably selected and operated laser 410 (as discussed in detail previously herein with respect to dark or black marking). The altered surfaces 404 combine to provide dark (e.g., black) marking of the metal structure 400. For example, the altered surfaces 404 appear to be dark or black and thus when selectively formed can provide dark marking. The resulting dark marking is visible through the anodized surface 402 which can be substantially translucent. If the anodized surface 402 is primarily clear, the resulting marking can be appear as dark (e.g., black). The marking can also be provided in darkness halftone in a suitably selected darkness halftone pattern. If the anodized surface is dyed or colored, the dark markings may appear in different colors.

Fluence of the optical energy may be above the damage threshold fluence for the base metal structure, for forming the altered structures 404. However, notwithstanding the foregoing, it should be understood that fluence of the optical energy that forms the altered structures 404 on the altered surfaces of the base metal structure may be selected to be approximately below the ablation threshold fluence for the base metal structure, so as to avoid deleterious effects, for example, predominant ablative stripping of the anodized surface or the base metal structure. Further, predominant fracturing of the anodized surface, or predominant delaminating of the anodized surface away from the base metal structure, may be substantially avoided by selectively limiting fluence of the optical energy that forms the altered structures. Fluence of the optical energy that forms the altered structures 404 on the altered surfaces of the base metal structure may be selected so that non-ablative laser-material interactions such as heating, surface melting, surface vaporization and/or plasma formation predominate over any ablation. In other words, by exercising due care in selection of the fluence of the optical energy that forms the altered structures on the altered surfaces of the base metal structure; ablation, which may be characterized by direct evaporation the metal, in an explosive boiling that forms a mixture of energetic gases comprising atoms, molecules, ions and electrons, may not predominate over non-ablative laser-material interactions, such as heating, surface melting, surface vaporization and/or plasma formation.

The laser 410 may include a galvanometer mirror or other arrangement for raster scanning a spot of the optical energy over the inner unanodized surface 406, so as to form the altered structures into a rasterized depiction of the marking indicia. Suitable pitch between raster scan lines of the scanning spot for the black marking may be selected. For example, a suitable pitch may be a fine pitch of about thirteen (13) microns. The laser 410 may further include optics for contracting or expanding size of the spot of the optical energy, by focusing or defocusing the spot. Expanding size of the spot, by defocusing the spot may be used to select fluence of the optical energy. In particular, expanding size of the spot may select fluence of the optical energy below the ablation threshold fluence for the base metal structure. Spot size of the optical energy for the nanosecond class laser mentioned previously herein may be within a range from approximately fifty (50) microns to approximately one hundred (100) microns; and spot size may be about seventy (70) microns.

FIG. 5 is a table illustrating exemplary laser operation parameters for dark (e.g., black) marking of a metal structure according to one embodiment. In particular, the table of FIG. 4D shows examples of various suitable laser models which may be used for marking the metal structure. The FOBA DP20GS is a Diode Pumped Solid State Neodymium-Doped Yttrium Orthovanadate (DPSS YVO4) type laser, which is available from FOBA Technology and Services GmbH, having offices at 159 Swanson Road, Boxborough, Mass. The SPI 12W/SM AND SPI 20W/SM are fiber type lasers, which are available from SPI Lasers UK, having offices at 4000 Burton Drive, Santa Clara, Calif. The Lumera is a picosecond type laser, which is available from LUMERA LASER GmbH, having an office at Opelstr 10, 67661 Kaiserslautern, Germany. It should be understood that the table of FIG. 5 shows approximate exemplary laser operating parameters, and that various other laser operating parameters may be selected to provide the fluence of the optical energy that forms the altered structures for dark or black marking of a base metal structure, wherein the fluence may be selected to be approximately below the ablation threshold fluence for the base metal structure.

Figure 6:
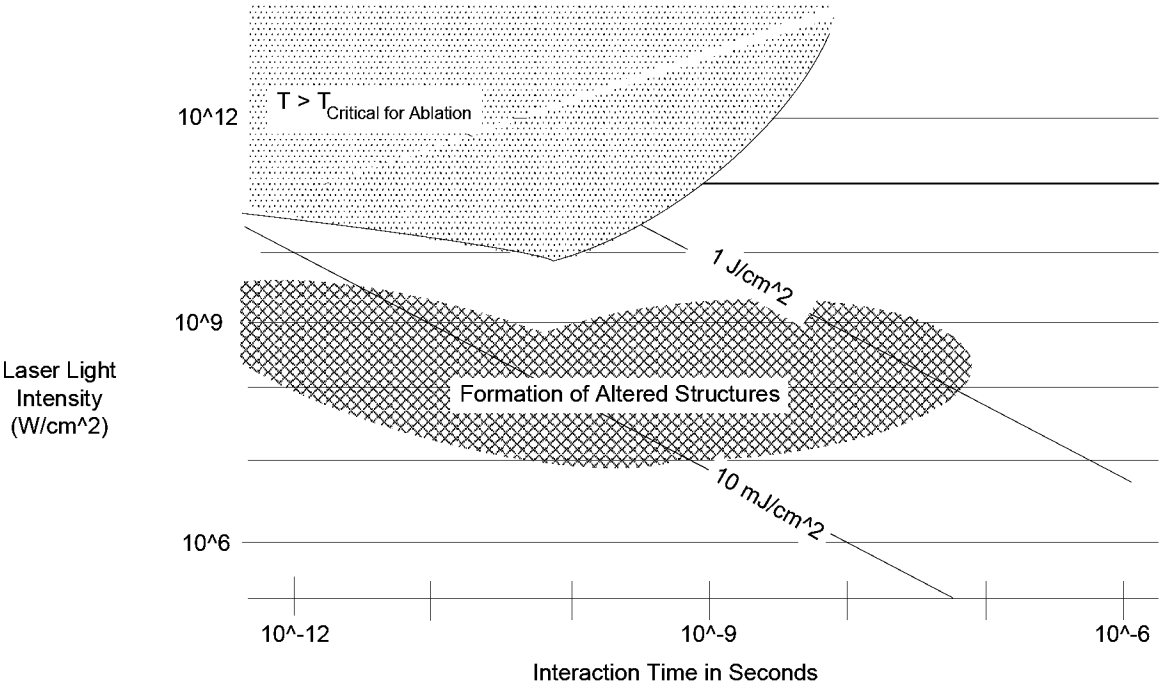
FIG. 6 is a diagram further illustrating exemplary laser operation parameters for dark or black marking of the metal structure according to one embodiment.

FIG. 6 is a diagram further illustrating exemplary laser operation parameters for dark (e.g., black) marking a metal structure according to one embodiment. In the diagram of FIG. 6, irradiance of Laser Light Intensity in Watts per square centimeter is shown along a vertical axis, while Interaction Time of each pulse of the laser light (optical energy) with the metal structure is shown in fractions of a second along a horizontal axis. For illustrative reference purposes, diagonal lines of constant fuence of approximately ten (10) milli-Joules per square centimeter and of approximately one (1) Joule per square centimeter are shown in FIG. 6. For substantially avoiding ablation of the metal structure, excessively high laser light intensity may be avoided, so that a temperature "T" of the metal structure may not substantially exceed a critical temperature for ablation of the metal structure. For example, a stippled region of exemplary excessively high laser light intensity is shown in FIG. 6, along with a descriptive legend T>T critical for ablation. FIG. 6 further shows a cross hatched region of suggested approximate parameters for formation of the altered structures for the dark or black marking.

Figure 7A:
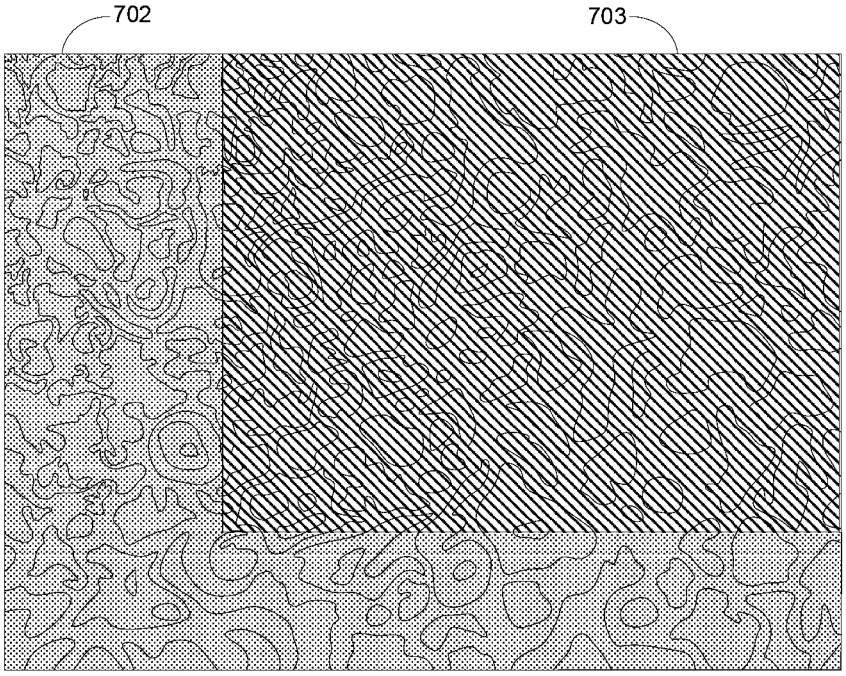
FIG. 7A is a diagram of a top view of an exemplary two-hundred times magnification photomicrograph of light or white marking of an anodized thin film surface of the metal structure according to one embodiment.

FIG. 7A is a diagram of a top view of an exemplary two-hundred times magnification photomicrograph of light (e.g., white) marking of an anodized thin film surface 702 of a metal structure according to one embodiment. The anodized thin film surface 702 may be substantially clear or translucent, however, as shown in FIG. 7A, slight curved island surface features of the anodized thin film surface 702 may be seen under the two-hundred times magnification. Further, the anodized thin film surface 702 may include light alterations 703 (depicted with left to right hatching) that may be created by microfracturing of the anodized thin film surface 702, while substantially maintaining adherent coupling of the aluminum oxide material of the anodized thin film surface adjacent to the inner unanodized surface of the metal structure. As depicted using stippling in FIG. 7A, the metal structure may appear gray and may be visible through an unaltered substantially clear or transparent remainder portion of the anodized thin film surface 702. Light scattering points may be created by microfracturing the anodized thin film surface for the light alterations 703, which may significantly obscure visibility of the metal structure through the anodized thin film surface.

Figure 7B:
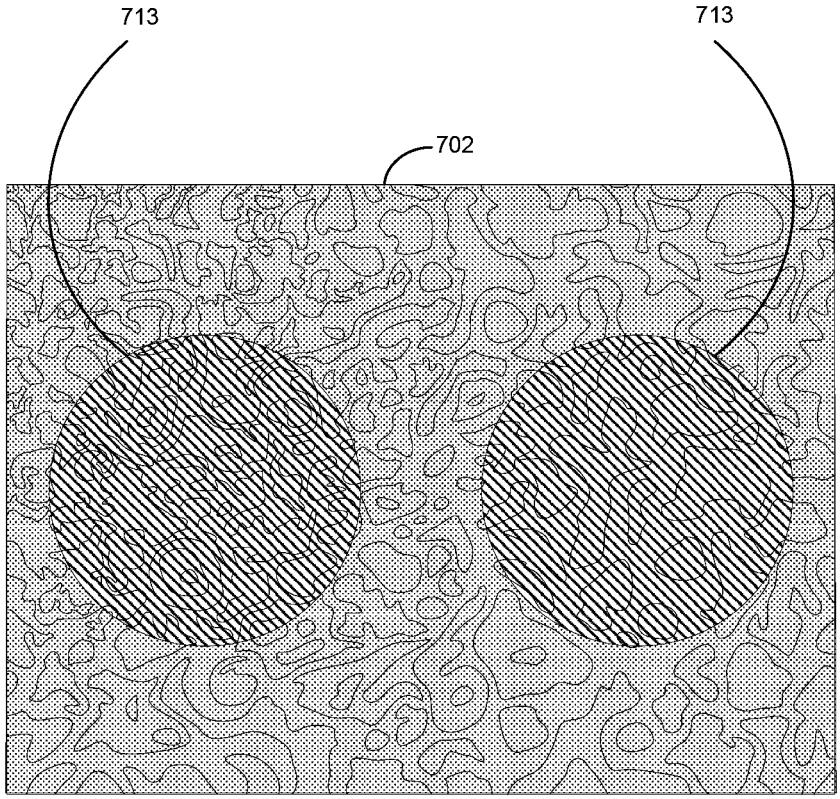
FIG. 7B is a diagram of a top view of an exemplary lightness halftone pattern for marking the anodized thin film surface of the metal structure according to another embodiment.

FIG. 7B is a diagram of a top view of an exemplary lightness halftone pattern 713 of light (e.g., white) alterations 713 (depicted with left to right hatching), which may be created by microfracturing of the anodized thin film surface 702. As depicted using stippling in FIG. 7B, the metal structure may appear gray and may be visible through the unaltered substantially clear or transparent remainder portion of the anodized thin film surface 702. Size of the light alterations 713, as well as spaced apart arrangement of the light alterations 713 in the lightness halftone pattern may be selected so as to provide a desired halftoning appearance.

Figure 7C:
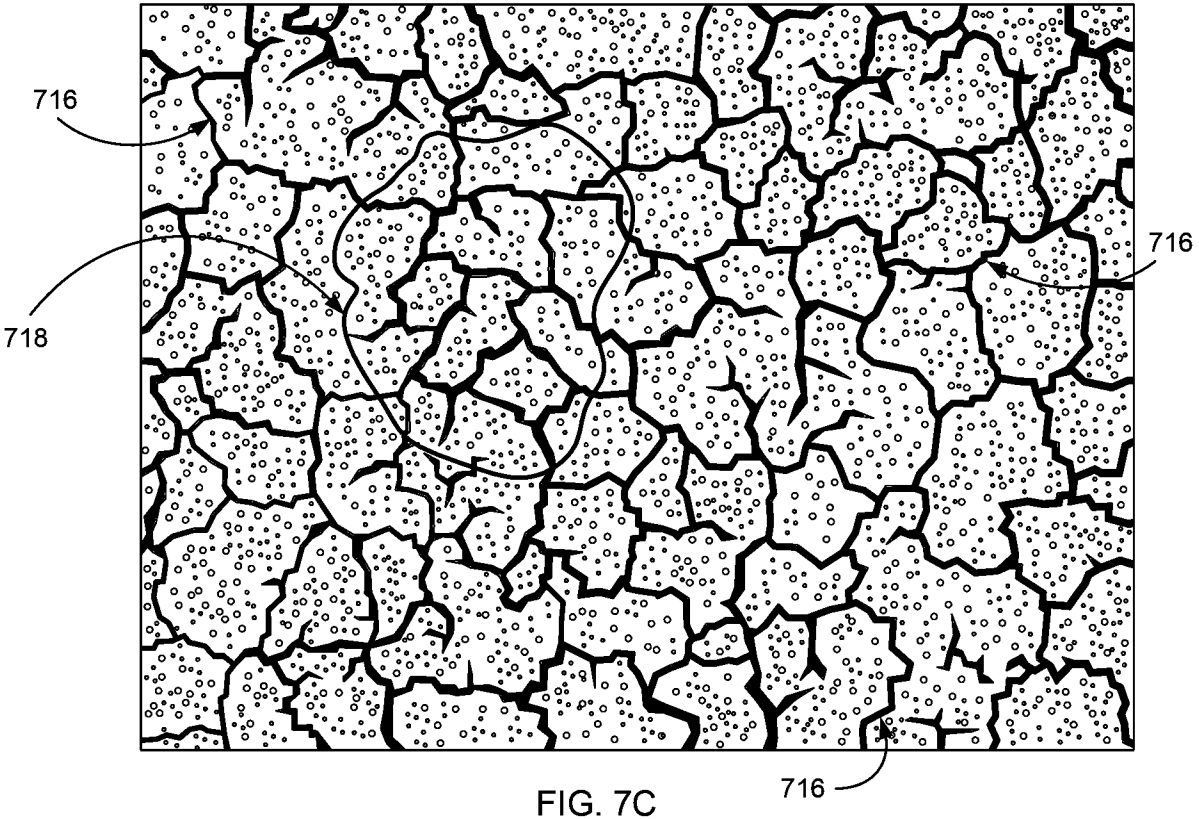
FIG. 7C is a diagram of a top view of an exemplary one thousand times magnification scanning electron micrograph of a microfractured region of the anodized thin film surface of the metal structure, for effecting the light or white marking of the metal structure.

FIG. 7C is a diagram of a top view of an exemplary one thousand times magnification scanning electron micrograph of a microfractured region of an anodized thin film surface of a metal structure, for effecting the light or white marking of the metal structure. Scanning electron microscopy can reveal details and features smaller than wavelengths of visible light. For example, anodic pores having diameters on the order of ten nanometers and extending into the anodized thin film surface are shown in FIG. 7C. The scanning electron micrograph reveals the structure of microfractures 716, having dimensions on a scale of less than one micron, wherein the microfractures 716 may produce substantial scattering of light at visible wavelengths. One slight curved island surface features 718 of the anodized thin film surface 702 is shown under one thousand times magnification in the diagram depiction of the scanning electron micrograph of FIG. 7C.

Figure 7D:
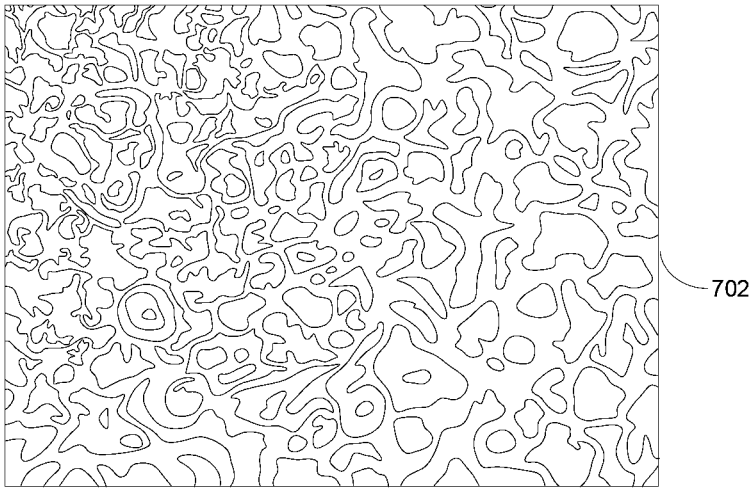
FIG. 7D is a diagram of an exemplary anodized thin film surface topography as measured by an optical surface profiler.

FIG. 7D is a diagram of an exemplary anodized thin film surface topography of the anodized thin film 702 as measured by an optical surface profiler, which at low magnification (e.g., less than two-hundred times magnification) may show substantially no perceptible change in the thin film surface topology for regions of light marking alterations, relative to remainder unaltered regions, without light marking alterations. Measurements, for example, can be made using ADE Phase Shift MicroXAM Optical interferometric profiler. Depictions of slight curved island surface features are shown in FIG. 7D for the anodized thin film surface topography of the anodized thin film 702. Typically, height magnitude of the slight curved island surface features may be less than about a couple of microns.

As mentioned previously herein, and as presently shown in FIG. 7D, substantially maintaining adherent coupling of the material of the anodized thin film 702 may substantially avoid etching of the material of the thin film material. More particularly, substantially maintaining adherent coupling of the aluminum oxide material of the anodized thin film 702 may substantially avoid etching the aluminum oxide material of the anodized thin film 702. Moreover, measurements by the optical surface profiler may show substantially no change in the anodized thin film surface topology due to selectively altering the thin film, while substantially maintaining adherent coupling of the material of the thin film. In particular, microfracturing the anodized thin film, while substantially maintaining adherent coupling of the material of the thin film, may show substantially no change in thin film surface topology in measurements by the optical surface profiler.

Figure 8A:
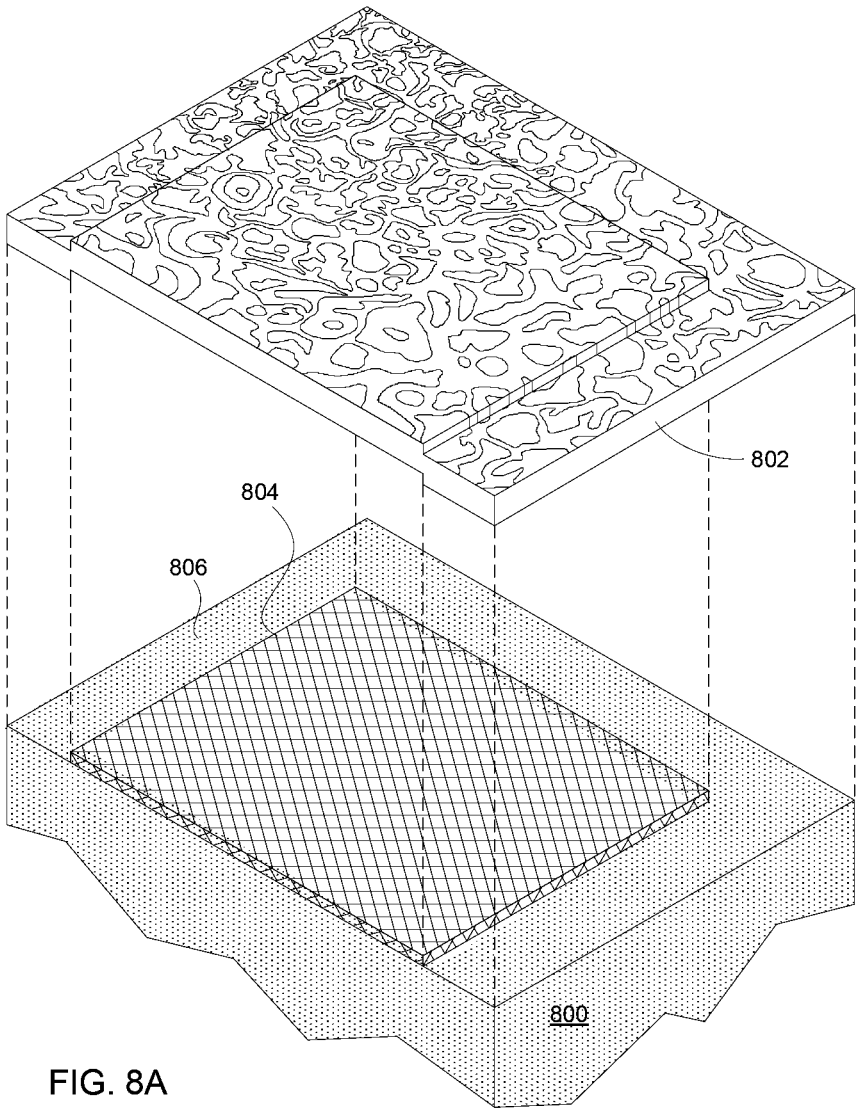
FIGS. 8A-8C are diagrams of various exemplary views representative of a two-hundred times magnification photomicrograph of dark or black marking the metal structure according to one embodiment.
Figure 8B:
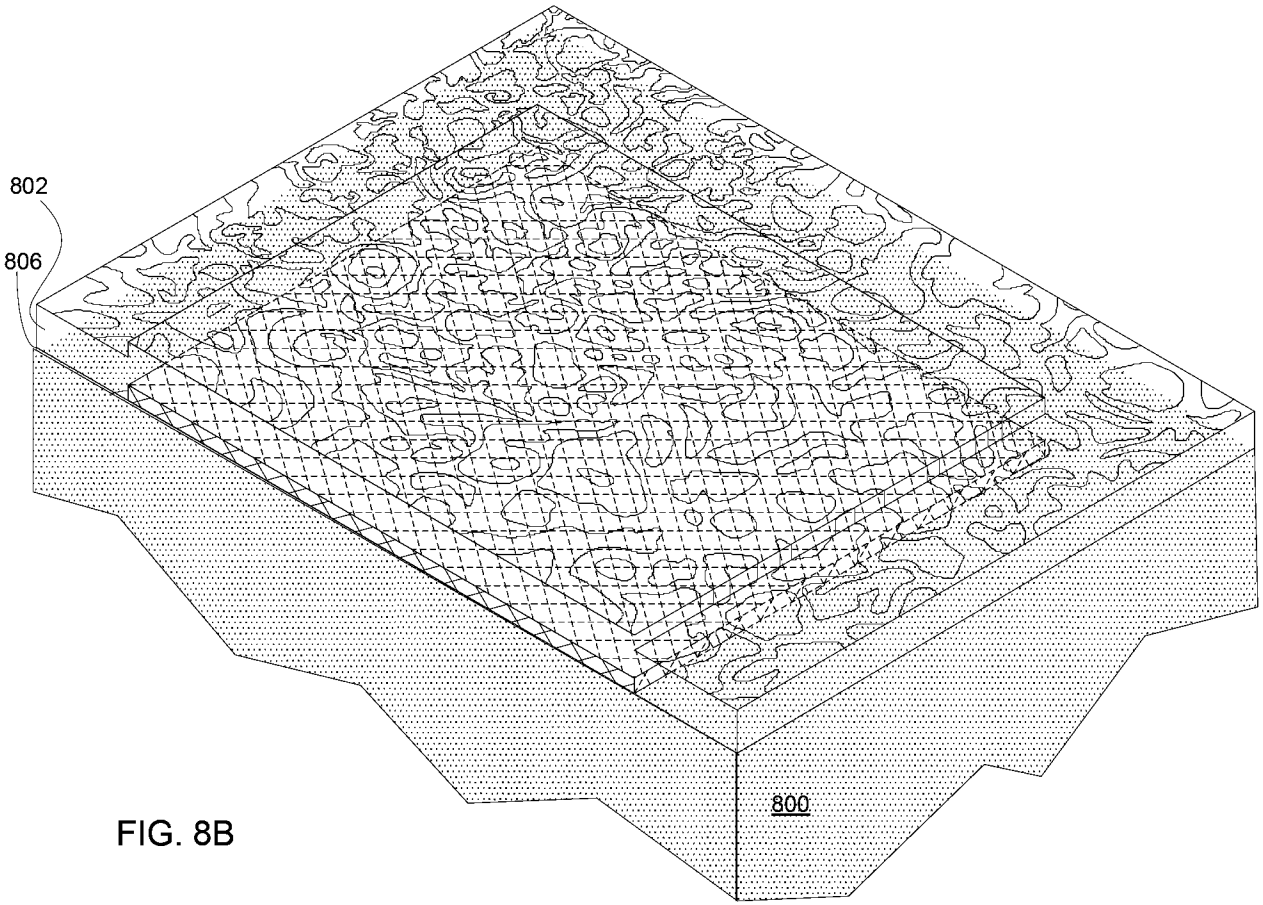
Figure 8C:
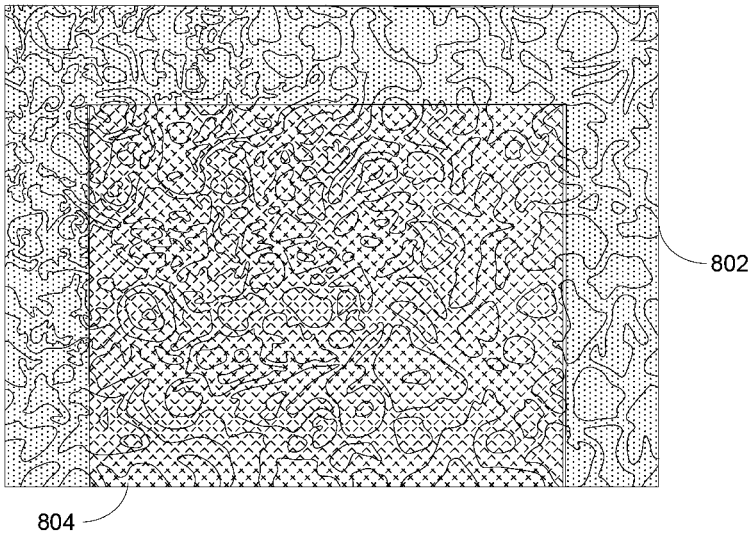

FIGS. 8A-8C are diagrams of various exemplary views representative of a two-hundred times magnification photomicrograph of dark (e.g., black) marking the metal structure according to one embodiment. Base metal structure 800 may appear gray, and is depicted in FIGS. 8A-8C using stippling. In FIG. 8A, the anodized thin film surface 802 is shown exploded away from the inner unanodized surface 806 of the base metal structure 800 in isometric view, so as to show clearly altered structures 804 (which are particularly highlighted using cross hatching). The altered structures 804 may correspond to selected roughened regions. The selected roughened regions may comprise ultrasmall scale roughening in selected regions of the inner unanodized surface 806 of the base metal structure 800. For example, the ultrasmall scale roughening may comprise nanoscale roughening. The anodized thin film surface 802, the altered structures 804 and the inner unanodized surface 806 of the base metal structure 400 are shown in a collapsed isometric view in FIG. 8B, and in a top view in FIG. 8C.

The anodized thin film surface 802 may appear substantially optically transparent as shown in FIGS. 8A through 8C; however, slight curved island surface features of the anodized thin film surface 802 may be seen under the two-hundred times magnification. Further, FIGS. 8A through 8C show a stepped plateau feature of the anodized thin film surface 802, which may be due to elevation by the altered structures 804, or may be due to an increase in volume contributed by the altered structures 804. A thickness of the stepped plateau feature may be slight, and may be about two to four microns. Accordingly, notwithstanding the slight stepped plateau feature of about two to four microns, selectively altering the unanodized metal surface 806 to produce the altered structures 804, substantially maintains adherent coupling of the material of the anodized thin film surface 802. The foregoing may substantially avoid etching or ablation of the material of the thin film material; may substantially maintain a tactilely smooth surface of the thin film; and/or may substantially avoid changes in thin film surface topology.

Figure 8D:
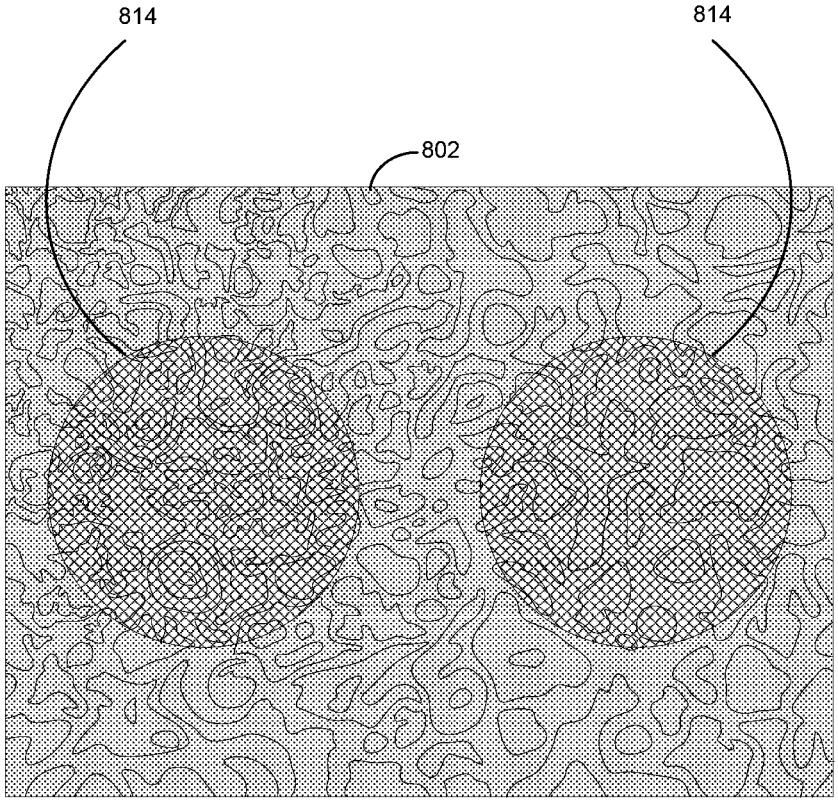
FIG. 8D is a diagram of a top view representative of an exemplary darkness halftone pattern for marking the metal structure according to another embodiment.

FIG. 8D is a diagram of a top view of an exemplary darkness halftone pattern 814 (depicted with cross hatching) for marking the metal structure according to another embodiment. As depicted using stippling in FIG. 8D, a metal structure may appear gray and may be visible through the unaltered substantially clear or transparent remainder portion of the anodized thin film surface 802. Size of the dark (e.g., black) alterations 814, as well as spaced apart arrangement of the dark alterations 814 in the darkness halftone pattern may be selected so as to provide a desired halftoning appearance.

Figure 9:
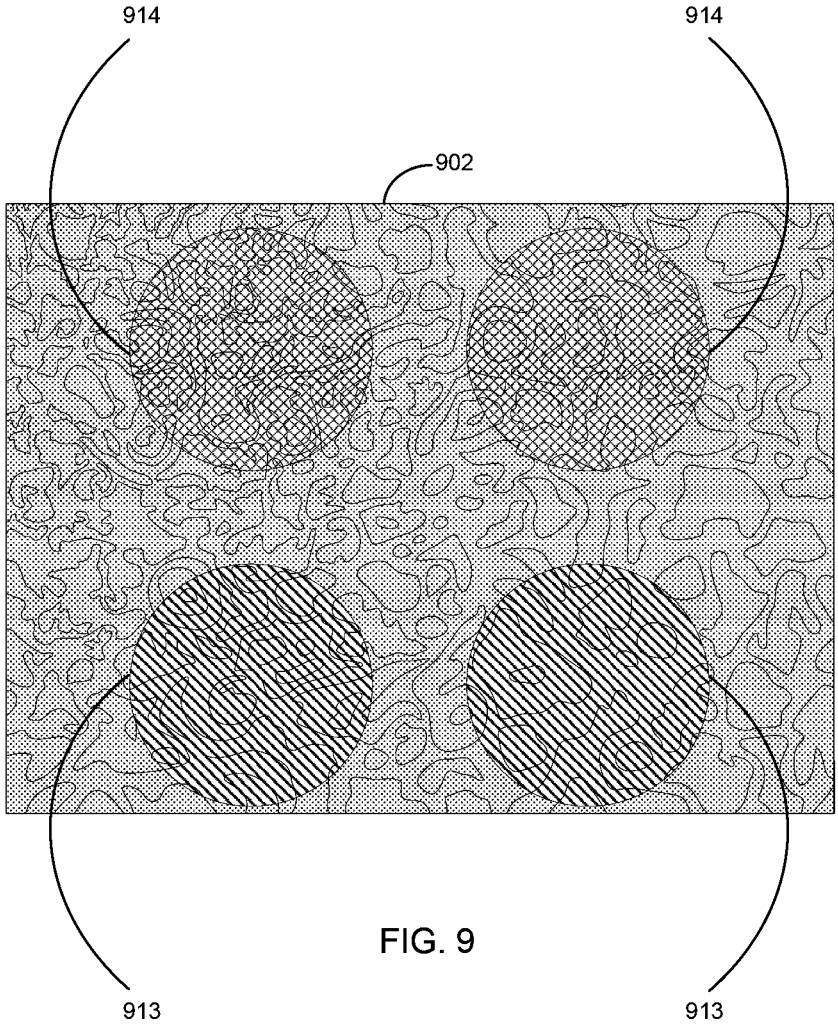
FIG. 9 is a diagram of a top view illustrating an exemplary lightness halftone pattern and a darkness halftone pattern for marking the metal structure according to another embodiment.

FIG. 9 is a diagram of a top view illustrating an exemplary lightness halftone pattern 913 (depicted with left to right hatching) and a darkness halftone pattern 914 (depicted with cross hatching) for marking the metal structure according to another embodiment. As depicted using stippling in FIG. 9, a metal structure may appear gray and may be visible through the unaltered substantially clear or transparent remainder portion of an anodized thin film surface 902. To provide a desired halftoning appearance, suitable selections may be made for sizes of the alterations 913, 914 as well as spaced apart arrangements of the alterations 913. 914 in the respective lightness and darkness halftone patterns.

Figure 10A:
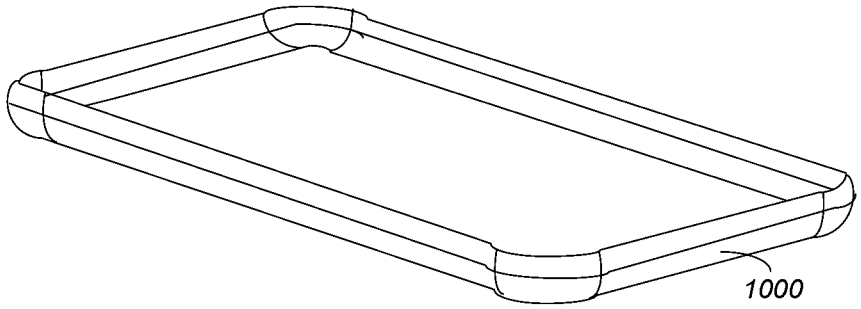
FIG. 10A is a diagrammatic representation of an exemplary product housing.

FIG. 10A is a diagrammatic representation of an exemplary product housing 1000. The housing 1000 may be formed using aluminum or another suitable metal. The housing 1000 may be a housing that is to be a part of an overall assembly. For example, the housing 1000 can be a bottom of a cell phone assembly or portable media player, or can be a portion of a housing for a personal computer or any other device having a metal housing.

Figure 10B:
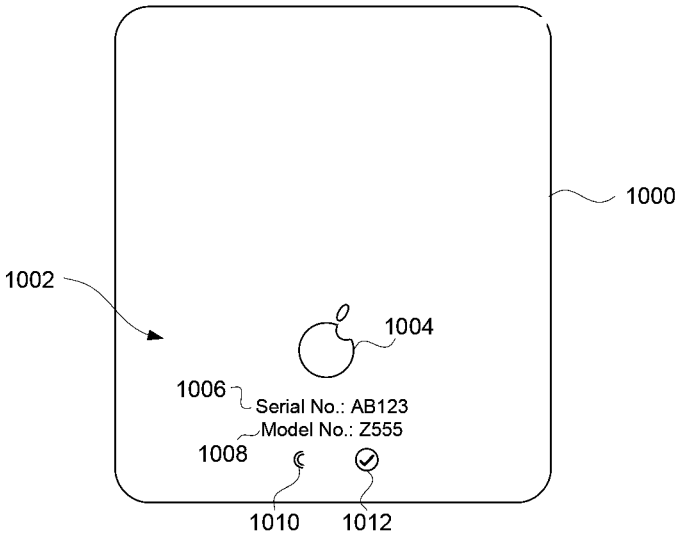
FIG. 10B illustrates the product housing having markings according to one exemplary embodiment.

FIG. 10B illustrates the product housing 1000 having markings 1002 according to one exemplary embodiment. The markings 1002 can be light or white markings in accordance with the light or white markings discussed previously herein. Alternatively or additionally, the markings 1002 can be dark or black markings produced on a sub-surface of the product housing 1000 in accordance with the dark or black markings discussed previously herein. In this example, the labeling includes a logo graphic 1004, serial number 1006, model number 1008, and certification/approval marks 1010 and 1012. Besides light (e.g., white) or dark (e.g., black) colors for marking, other colors or shades can be provided by halftoning and/or dyes.

The marking processes described herein are, for example, suitable for applying text or graphics to a housing surface (e.g., an outer housing surface) of a device, such as an electronic device. The marking processes are, in one embodiment, particularly well-suited for applying text and/or graphics to an outer housing surface of a portable electronic device. Examples of portable electronic devices include mobile telephones (e.g., cell phones), Personal Digital Assistants (PDAs), portable media players, portable computers, remote controllers, pointing devices (e.g., computer mouse), game controllers, etc. The portable electronic device can further be a hand-held electronic device. The term hand-held generally means that the electronic device has a form factor that is small enough to be comfortably held in one hand. A hand-held electronic device may be directed at one-handed operation or two-handed operation. In one-handed operation, a single hand is used to both support the device as well as to perform operations with the user interface during use. In two-handed operation, one hand is used to support the device while the other hand performs operations with a user interface during use or alternatively both hands support the device as well as perform operations during use. In some cases, the hand-held electronic device is sized for placement into a pocket of the user. By being pocket-sized, the user does not have to directly carry the device and therefore the device can be taken almost anywhere the user travels (e.g., the user is not limited by carrying a large, bulky and often heavy device).

This application is also references: (i) U.S. Provisional Patent Application No. 61/121,491, filed Dec. 10, 2008, and entitled "Techniques for Marking Product Housings," which is hereby incorporated herein by reference; (ii) U.S. patent application Ser. No. 12/358,647, filed Jan. 23, 2009, and entitled "Method and Apparatus for Forming a Layered Metal Structure with an Anodized Surface," which is hereby incorporated herein by reference; (iii) U.S. patent application Ser. No. 12/475,597, filed May 31, 2009, and entitled "Techniques for Marking Product Housings," which is hereby incorporated herein by reference; (iv) U.S. application Ser. No. 12/643,772, filed Dec. 21, 2009 and entitled "SUB-SURFACE MARKING OF PRODUCT HOUSINGS," which is hereby incorporated herein by reference; and (v) U.S. application Ser. No. 12/895,384, filed Sep. 30, 2010 and entitled "SUB-SURFACE MARKING OF PRODUCT HOUSINGS," which is hereby incorporated herein by reference.

The various aspects, features, embodiments or implementations of the invention described above can be used alone or in various combinations.

Different aspects, embodiments or implementations may, but need not, yield one or more of the following advantages. One advantage of the invention is that durable, high precision markings can be provided to product housings. As an example, the markings being provided on a product housing that not only have high resolution and durability but also provide a smooth and high quality appearance. Another advantage is that the marking techniques are effective for surfaces that are flat or curved.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A method for marking an article, comprising:

providing a metal structure for the article;

adherently coupling material of a thin film adjacent to a surface of the metal structure, so as to provide a resulting structure having a lightness factor magnitude in a visible color space, and a tactilely smooth surface; and selectively altering the thin film to increase the lightness factor magnitude of selected regions of the resulting structure by stippling with a laser, while maintaining adherent coupling of the material of the thin film, wherein:

the stippling within the selected region comprises creating an array of light alterations with adjacent pairs of light alterations having an unaltered region there between;

each of the light alterations formed by a single laser pulse having a spot size diameter between approximately 50 microns and approximately 100 microns; and the selectively altering the thin film comprises microfracturing selected regions of the thin film that are near the surface of the metal structure while maintaining the tactilely smooth surface.

2. The method as recited in claim 1, wherein the selectively altering the thin film increases the lightness factor magnitude to be above fifty.

3. The method as recited in claim 1, wherein the selectively altering the thin film comprises white marking of the resulting structure.

4. The method as recited in claim 1, wherein the structure is visible through the thin film.

5. A method for marking an article, comprising:

providing a metal structure for the article;

adherently coupling material of a thin film adjacent to a surface of the metal structure, so as to provide a resulting structure having a lightness factor magnitude in a visible color space and a smooth protective surface; and altering the lightness factor magnitude, using a laser, of regions of the resulting structure that is visible through the thin film by stippling, comprising creating an array of light alterations with adjacent pairs of light alterations having an unaltered region there between, while maintaining adherent coupling of the material of the thin film, wherein:

each of the light alterations is formed by a single laser pulse having a spot size diameter between approximately 50 microns and approximately 100 microns; and altering the lightness factor magnitude comprises microfracturing selected regions of the thin film that are near the surface of the metal structure while maintaining the smoothness of the protective surface.

6. A method for marking an article, comprising:

providing an article comprising aluminum metal;

anodizing the article to create tactilely smooth anodized layer; and marking the article that is visible through the anodized layer by stippling, by creating an array of light alterations with adjacent pairs of light alterations having an unaltered region there between, each of the light alterations formed by a single laser pulse with a spot size diameter between approximately 50 microns and approximately 100 microns within the anodized layer using a laser, wherein the forming the light alterations comprises fracturing selected regions of the anodized layer that are adjacent to the surface of the metal structure while maintaining the tactilely smooth anodized layer.

7. The method as recited in claim 6, wherein the light alterations provide a white or translucent appearance within the anodized layer above the aluminum metal.

8. The method as recited in claim 7, wherein the marking comprises inducing microfractures in the anodized layer to provide the light alterations.

* * * * *